United States Patent [19]

Rossman et al.

[11] 4,285,634

[45] Aug. 25, 1981

[54] COMPOSITE CERAMIC GAS TURBINE BLADE

[75] Inventors: Axel Rossman, Karlsfeld; Wilhelm Hoffmüller, Munich; Wolfgang Krüger, Priel, all of Fed. Rep. of Germany

[73] Assignee: Motoren-und Turbinen-Union München GmbH, Munich, Fed. Rep. of Germany

[21] Appl. No.: 65,062

[22] Filed: Aug. 9, 1979

[30] Foreign Application Priority Data

Aug. 9, 1978 [DE] Fed. Rep. of Germany ..... 2834864

[51] Int. Cl.³ ..... F01D 5/18

[52] U.S. Cl. ..... 416/97 A; 416/241 B

[58] Field of Search ..... 416/241 B, 225, 226, 416/97

[56] References Cited

U.S. PATENT DOCUMENTS

| | | | |
|---|---|---|---|
| 2,896,907 | 7/1959 | Freche | 416/92 |
| 2,958,505 | 11/1960 | Frank | 416/92 |
| 3,443,792 | 5/1969 | Moss | 416/241 B |
| 3,619,077 | 11/1971 | Wile | 416/241 B |
| 3,658,439 | 4/1972 | Rydd | 416/92 |
| 3,967,353 | 7/1976 | Dagnotta | 416/96 R |
| 4,213,739 | 7/1980 | Eulor | 416/226 |

FOREIGN PATENT DOCUMENTS

| | | | |
|---|---|---|---|
| 139969 | 1/1951 | Australia | 416/95 |
| 718939 | 2/1942 | Fed. Rep. of Germany | 416/241 B |
| 735668 | 5/1943 | Fed. Rep. of Germany | 416/241 B |
| 57426 (Addition to No. 999820) | 11/1952 | France | 416/241 B |
| 660007 | 10/1951 | United Kingdom | 416/96 |
| 914548 | 1/1963 | United Kingdom | 416/241 B |

*Primary Examiner*—William L. Freeh

*Attorney, Agent, or Firm*—Scully, Scott, Murphy & Presser

[57] ABSTRACT

A gas turbine blade constituted of a supportive metallic blade core and a thin-walled ceramic blade airfoil, in which the airfoil is supported against a tip plate of the blade core. The blade core consists of rod or wire-shaped pins which have widened bases at their radially inner ends. Through these widened bases, the pins are retained in a metallic adapter slidable into a turbine disc.

8 Claims, 2 Drawing Figures

COMPOSITE CERAMIC GAS TURBINE BLADE

BACKGROUND OF THE INVENTION

1. Field of the Invention

The present invention relates to a gas turbine blade and, more particularly, to a rotor blade, which is combined of a supportive metallic core having a root formed at the lower end thereof, and of a ceramic airfoil encompassing it at a spacing.

2. Discussion of the Prior Art

An operationally safe joint between these two blade components is difficult to produce, and namely because of their different thermal expansion, and also because of the danger of abrasion through centrifugal pressure and vibrations, and primarily due to the danger of fracture of the brittle ceramic material. The latter material will fairly well withstand static pressure, but not tensile stress. The heretofore known designs disclosed have, as a consequence, failed to succeed notwithstanding their partially high constructional complexity or demand.

SUMMARY OF THE INVENTION

Accordingly, it is a primary object of the present invention to provide a gas turbine blade of the above described type which meets the rigid demands of gas turbine operation with an acceptable complexity of construction.

It is a more specific object of the present invention to provide a blade of the above type in which the core and the airfoil are allowed to expand and contract independently of each other at different rates of expansion; in which the mutual contacting surface is large so as to provide a low surface pressure, while, finally, the tensile load imposed on the ceramic component by centrifugal force is extremely low.

BRIEF DESCRIPTION OF THE DRAWINGS

Reference may now be had to a preferred embodiment of the invention, taken in conjunction with the accompanying drawings; in which.

DETAILED DESCRIPTION

Figure 1A:
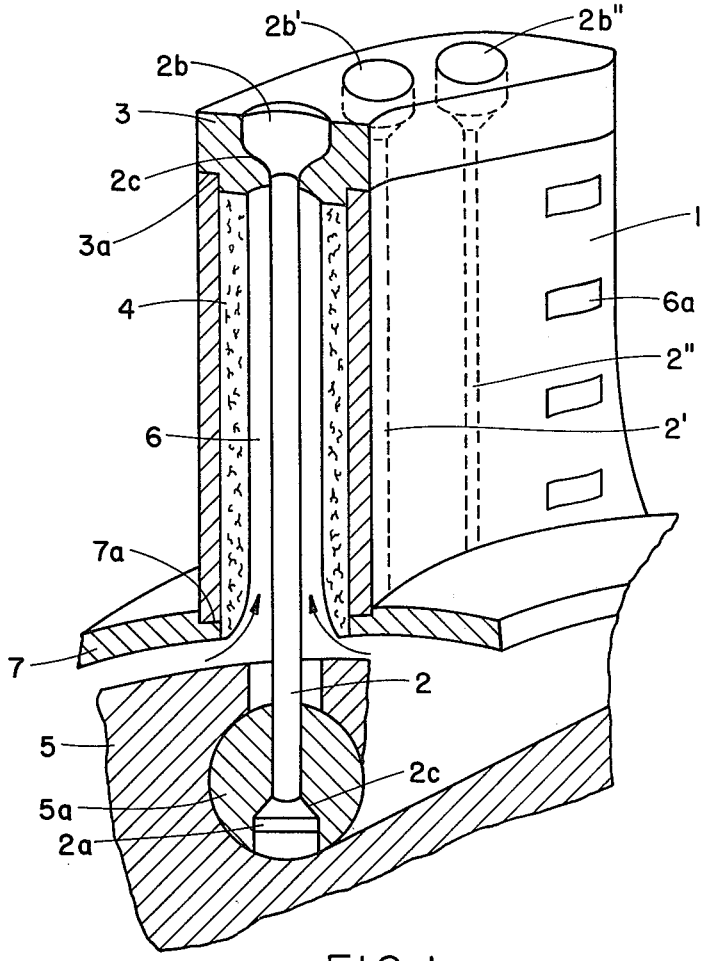
FIG. 1*a* is a longitudinal sectional view taken along line A—A in FIG. 1.
Figure 1:
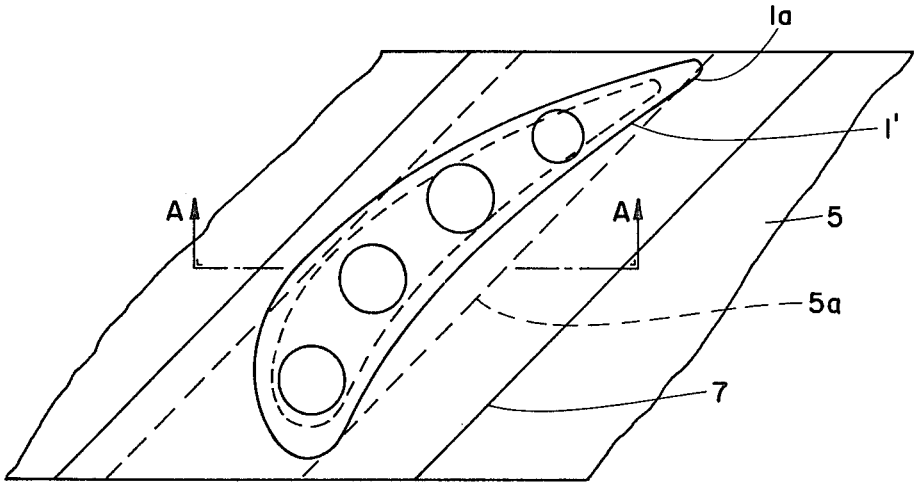
FIG. 1 is a plan view illustrating the blade of the present invention inclusive of a portion of the rotor disk.

Having now reference to FIG. 1*a*, a thin-walled ceramic airfoil 1 engages from below into a recess 3*a* in a tip plate 3 of a circumference correponding with the airfoil section. The tip plate is also constituted of ceramic and is supported by four rod-shaped metallic blade cores, of which the three rearward, namely 2, 2' and 2'' are visible in the drawing, through the widened head 2*b*, 2*b'* and 2*b''* of each. The support in the turbine disk 5 is achieved by respectively each widened head 2*a*, and so forth; these lower heads support themselves against a common, cylindrical metallic adaptor 5*a* which is slid into the turbine disc and locked in place therein. All supporting surfaces are herein conically shaped.

The airfoil can be constituted of a plurality of sections along its span or length and change over into a base plate or pedestal at its lower end. However, in the illustrated embodiment, the rotor foil 1 has a separate ceramic pedestal 7 at the lower end thereof which evidences a recess 7*a* for the insertion of the airfoil. The base portions of all blades form a continuous closed ring while allowing narrow gaps to remain therebetween. A layer 4 of a yieldable material is arranged in the interior of the airfoil 1, for example, ceramic foam or a felting of ceramic fiber with cooling air ducts 6 being permitted to extend in the longitudinal direction of the blade. These ducts extend into outlet ports 6*a* which are arranged in the concave surface 1' of the airfoil near the trailing edge 1*a* of the blade.

The upper tip 2*b*, 2*b'* and 2*b''* of the rod-shaped blade cores 2, 2' and 2'' is formed through plastic deformation, diffusion welding or high-temperature brazing after the mounting of the blade airfoil 1 including the tip plate 3.

What is claimed is:

1. In a gas turbine blade having a plurality of supporting metallic blade cores extending therethrough; a ceramic airfoil enveloping the cores at a spacing therefrom; a tip plate formed of ceramic material having a circumference in conformance with the airfoil, said airfoil engaging in a recess in said tip plate, each blade core having a widened head for restraining the tip plate, each core being a wire-shaped blade core including a root at the radially inward end thereof; and a generally cylindrical metallic adaptor adapted to be inserted and locked in a turbine disc for commonly supporting the blade by each core root.

2. Gas turbine blade as claimed in claim 1, the head and the root of said blade core including conical abutment surfaces.

3. Gas turbine blade as claimed in claim 1, said airfoil extending into a pedestal at the lower end thereof whereby in the assembled condition of a plurality of blades in the turbine disc the pedestals of all blades form a continuous closed ring while permitting narrow gaps to remain therebetween.

4. Gas turbine blade as claimed in claim 1, including a ceramic pedestal at the lower end of the airfoil, said pedestal having a recess for inserting the airfoil such that in the assembled condition in the turbine disc the pedestals of a plurality of blades form a continuous closed ring while permitting narrow gaps to remain therebetween.

5. Gas turbine blade as claimed in claim 1, wherein the airfoil consists spanwise of a plurality of mortised sections.

6. Gas turbine blade as claimed in claim 1, wherein in that the widened head of the blade core is formed by plastic deformation, diffusion welding or high-temperature brazing subsequent to the airfoil and tip plate being mounted.

7. Gas turbine blade as claimed in claim 1, comprising a layer of a yieldable material, such as ceramic foam or a felting of ceramic fibers, is arranged in the interior of the airfoil, and cooling air ducts in said blade airfoil extending in a generally spanwise direction.

8. Gas turbine blade as claimed in claim 7, wherein the cooling air ducts communicate with cooling air outlet ports arranged in the concave surface of the airfoil proximate the trailing edge of the blade.

* * * * *